US005789862A

United States Patent [19]

Makino

[11] Patent Number: 5,789,862

[45] Date of Patent: Aug. 4, 1998

[54] SURFACE DISCHARGE AC PLASMA DISPLAY PANEL

[75] Inventor: Mitsuyoshi Makino, Tokyo, Japan

[73] Assignee: NEC Corporation, Tokyo, Japan

[21] Appl. No.: 871,133

[22] Filed: Jun. 6, 1997

[30] Foreign Application Priority Data

Jun. 7, 1996 [JP] Japan ..... 8-145604

[51] Int. Cl.[6] ..... H01J 17/49

[52] U.S. Cl. ..... 313/584; 313/581; 313/585; 313/586

[58] Field of Search ..... 313/581, 584, 313/582, 585, 586, 587; 345/41, 60

[56] References Cited

U.S. PATENT DOCUMENTS

| | | | |
|---|---|---|---|
| 5,182,489 | 1/1993 | Sano | 313/586 X |
| 5,440,201 | 8/1995 | Martin et al. | 313/584 X |
| 5,525,862 | 6/1996 | Miyazaki | 313/584 X |
| 5,541,749 | 7/1996 | Nagakubo | 313/586 |
| 5,587,624 | 12/1996 | Komachi | 313/584 |
| 5,714,841 | 2/1998 | Miyazaki | 313/585 |

OTHER PUBLICATIONS

T. Akiyama et al., "Evaluations of Discharge Cell Structure for color AC Plasma Display Panels", Proceedings of the 15th International Display Research Conference, Oct. 1995, pp. 377–380.

*Primary Examiner*—Ashok Patel

*Attorney, Agent, or Firm*—Sughrue, Mion, Zinn, Macpeak & Seas PLLC

[57] ABSTRACT

An AC plasma display panel includes first and second plates, a discharge space, a plurality of pairs of scan electrodes and common electrodes, and a plurality of data electrodes. The first and second plates are arranged opposite to each other through a predetermined gap, at least one of which is transparent. The discharge space is partitioned into a plurality of pixels. The pairs of scan electrodes and common electrodes are formed on the inner surface of the first plate in the row direction to allow emission sustaining surface discharge therebetween. The pixels are arranged at the intersections of the scan and common electrodes and the data electrodes. In this arrangement, the following relation is established $0.80 \leqq h/d \leqq 1.25$ where d is the surface discharge gap between the scan and common electrodes, and h is the opposing discharge gap between the scan and common electrodes and the data electrodes.

4 Claims, 7 Drawing Sheets

SURFACE DISCHARGE AC PLASMA DISPLAY PANEL

BACKGROUND OF THE INVENTION

The present invention relates to a surface discharge AC plasma display panel used for display outputs of a personal computer and a workstation, a wall-mounted television, and the like, as a flat display panel which can be easily enlarged and, more particularly, to its electrode structure.

Plasma display panels (PDPs) are classified into the following two types in terms of their operation schemes. Plasma display panels of the first type are DC plasma display panels in which electrodes are exposed to a discharge gas to allow discharge while the voltage is applied. Plasma display panels of the second type are AC plasma display panels in which electrodes are covered with a dielectric so as not to be exposed to the discharge gas and allow discharge. In the AC plasma display panel, the discharge cell itself has a memory function because of the charge accumulation effect of the dielectric.

In a conventional AC-PDP, a face plate having a large number of pairs of scan and common electrodes formed in the row direction opposes a back plate having a large number of data electrodes formed in the column direction, through a discharge space filled with a discharge gas. The scan and common electrodes are insulated from each other by an insulating layer formed on the face plate. The data electrodes are insulated from each other by an insulating layer formed on the back plate, and a phosphor is formed on this insulating layer. The scan and common electrodes and the data electrodes are arranged with a predetermined opposing discharge gap. The scan electrodes and the common electrodes are arranged with a predetermined surface discharge gap.

In the PDP having this arrangement, writing discharge which determines emission/non-emission of each pixel is discharge (opposing discharge) through the opposing discharge gap. This opposing discharge gap is a space between the insulating layer on the face plate and the insulating layer on the back plate. Sustaining discharge which determines the light emission quantity is discharge (surface discharge) within the discharge space through the surface discharge gap as the gap between the scan and common electrodes.

As for the surface discharge, it is found that the luminous efficiency is higher for a wider surface discharge gap, as shown in "Evaluation of Discharge Cell Structure for Color AC Plasma Display Panels", PROCEEDINGS OF THE 15TH INTERNATIONAL DISPLAY RESEARCH CONFERENCE, pp. 377–380, OCTOBER 1995.

Since the conventional AC-PDP is constituted as above, if the surface discharge electrode gap is simply widened to increase the luminous efficiency, the voltage margin of a sustain pulse for sustaining light emission disadvantageously decreases due to the following reason. If the surface discharge electrode gap is simply widened, opposing discharge occurs by a sustain pulse for allowing sustaining discharge as surface discharge. Due to occurrence of this opposing discharge, the voltage margin of the sustain pulse decreases. The AC-PDP with wide gap structure cannot be properly driven by the conventional driving method.

This is because the firing voltage of surface discharge and the firing voltage of opposing discharge do not properly match. The Vf–P·d characteristic representing the relationship between a firing voltage Vf, a discharge gas pressure P, and a discharge electrode gap d according to the Paschen's law is shown in FIG. 7. That is, when the discharge gas pressure P is constant, the firing voltage Vf depends on the discharge electrode gap d. Note that C1 and C2 are constants determined by the gas composition and the pixel configuration.

In general, discharge used in the PDP is determined by the discharge gas pressure P and the discharge electrode gap d which fall within the range having values larger than the minimum values of a Paschen curve shown in FIG. 7. The firing voltage Vf increases with an increase in discharge electrode gap d. Therefore, an increase in surface discharge electrode gap d in the conventional PDP structure leads to an increase in Vf of surface discharge. To allow proper sustaining discharge, the voltage value of the sustain pulse must be increased by the increase amount of the Vf of surface discharge.

As a result, the opposing discharge undesirably occurs between the scan and common electrodes and the data electrodes having the GND potential upon application of the sustain pulse.

SUMMARY OF THE INVENTION

It is an object of the present invention to provide a surface discharge AC plasma display panel having a high luminous efficiency while preventing unnecessary opposing discharge even when the surface discharge gap is widened.

In order to achieve the above object, according to the present invention, there is provided an AC plasma display panel comprising first and second plates arranged opposite to each other through a predetermined gap, at least one of which is transparent, a discharge space defined by the first and second plates and filled with a discharge gas, the discharge space being partitioned into a plurality of pixels, a plurality of pairs of scan electrodes and common electrodes formed on an inner surface of the first plate in a row direction to allow emission sustaining surface discharge therebetween, and a plurality of data electrodes formed on an inner surface of the second plate in a column direction to allow writing emission opposing discharge between the data electrodes and the scan electrodes, the pixels being arranged at intersections of the scan and common electrodes and the data electrodes, wherein the following relation is established $$0.80 \leqq h/d \leqq 1.25$$

where d is a surface discharge gap between the scan and common electrodes, and h is an opposing discharge gap between the scan and common electrodes and the data electrodes.

DESCRIPTION OF THE PREFERRED EMBODIMENT

The present invention will be described below with reference to the accompanying drawings.

Figure 1:
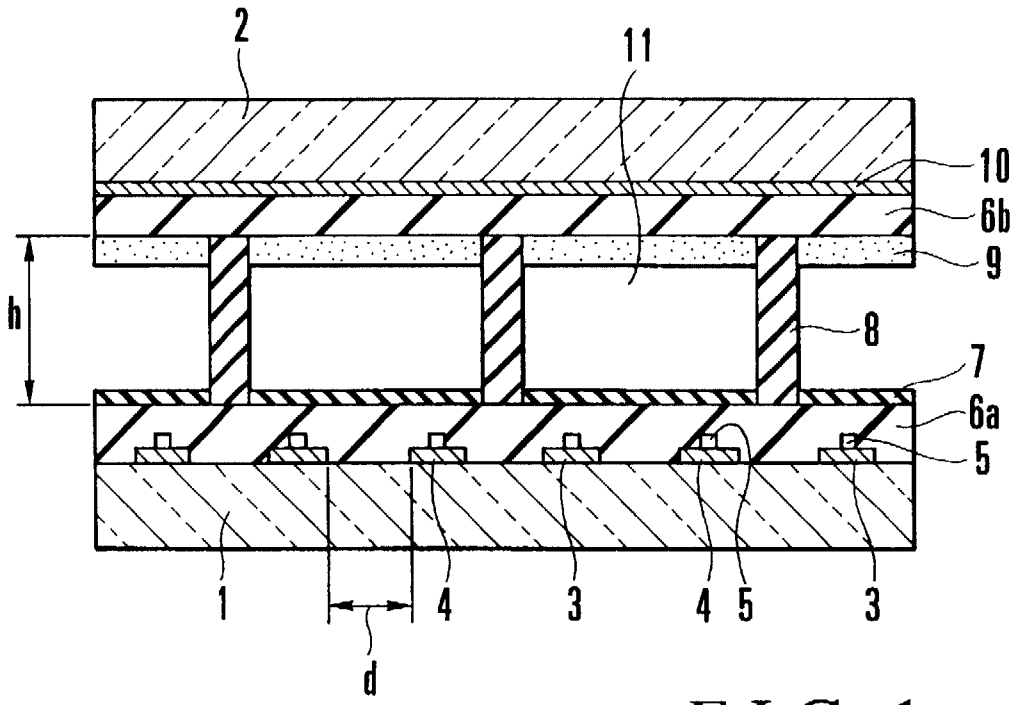
FIG. 1 is a sectional view showing the arrangement of an AC-PDP according to an embodiment of the present invention.

FIG. 1 shows the arrangement of an AC-PDP according to an embodiment of the present invention. Referring to FIG. 1, the PDP has a structure sandwiched between a face plate 1 consisting of glass and a back plate 2 similarly consisting of glass. A plurality of pairs of scan electrodes 3 and common electrodes 4 arrayed in rows (to be described later), and metal electrodes 5 formed on the scan and common electrodes 3 and 4 to supply a sufficient current are formed on the face plate 1. An insulating layer 6*a* and a protective layer 7 consisting of MgO or the like to protect the insulating layer 6*a* from discharge are sequentially formed on the face plate 1 having the scan and common electrodes 3 and 4.

A large number of data electrodes 10 arrayed in columns (to be described later) are formed on the back plate 2. An insulating layer 6*b* is formed on the back plate 2 having the data electrodes 10. A phosphor 9 for converting ultraviolet rays generated upon discharge into visible light is formed on the insulating layer 6*b*. Partitions 8 are formed between the insulating layers 6*a* and 6*b* at predetermined intervals. The partitions 8 are used to ensure a discharge space 11 between the protective layer 7 and the phosphor 9 and to form the discharge spaces 11 in correspondence with pixels. A gas mixture of He, Ne, Xe, and the like is filled as a discharge gas in the discharge space 11. The scan and common electrodes 3 and 4 and the data electrodes 10 are arranged through a predetermined opposing discharge gap h. The scan electrodes 3 and the common electrodes 4 are arranged through predetermined discharge electrode gaps d.

Figure 2:
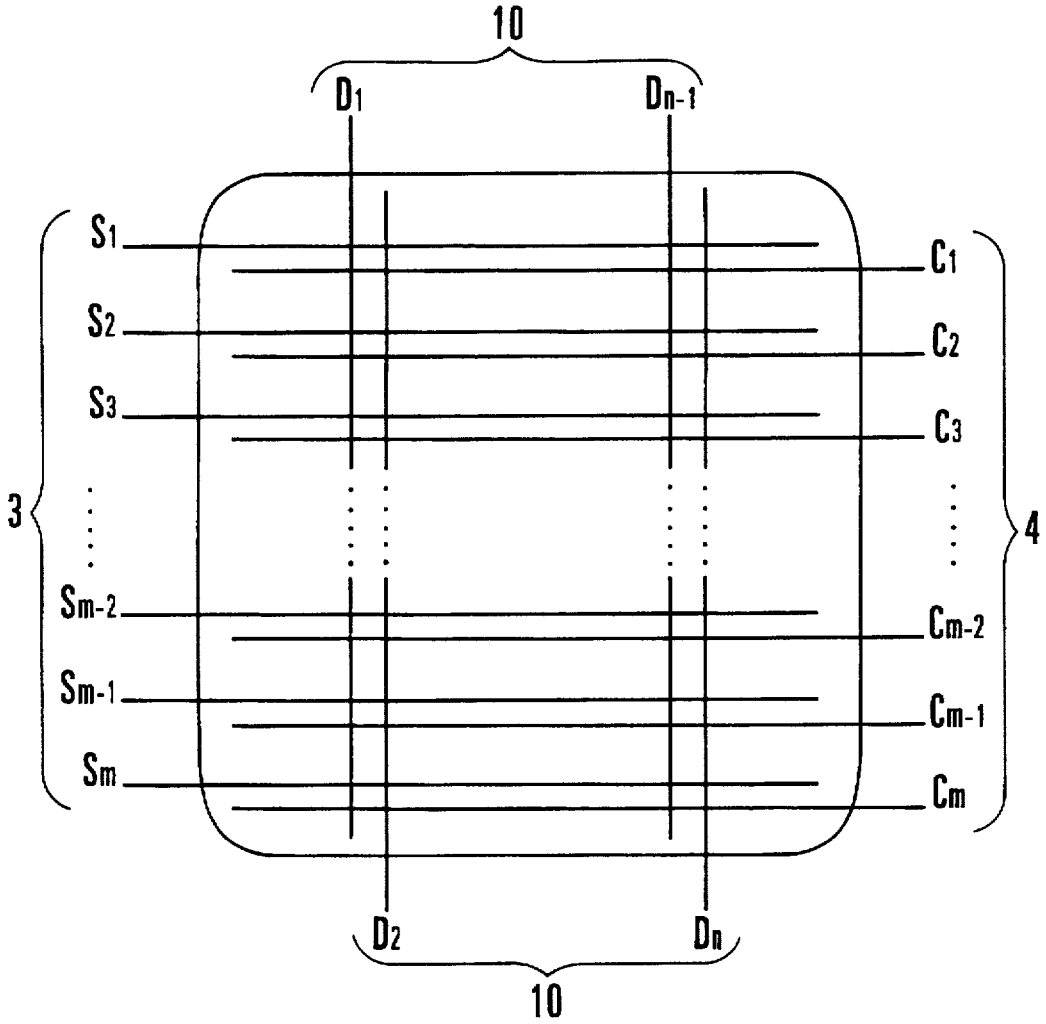
FIG. 2 is a plan view showing the layout of the electrodes of the PDP shown in FIG. 1.

As shown in FIG. 2, the pairs of scan and common electrodes 3 and 4 constitute row electrodes electrically noncontact with each other, the data electrodes 10 constitute column electrodes, and they are arrayed in a matrix. The intersection of a pair of row electrodes Si and Ci (i=1, 2, . . . , m) of the scan and common electrodes 3 and 4 and a column electrode Dj (j=1, 2, . . . , n) of the data electrode 10 forms one pixel. In this arrangement, the phosphor 9 shown in FIG. 1 is colored with three different colors R, G, and B (Red, Green, and Blue) in units of pixels, thereby obtaining a color display PDP.

Figures 3A, 3B, 3C, 3D, 3E, 3F:
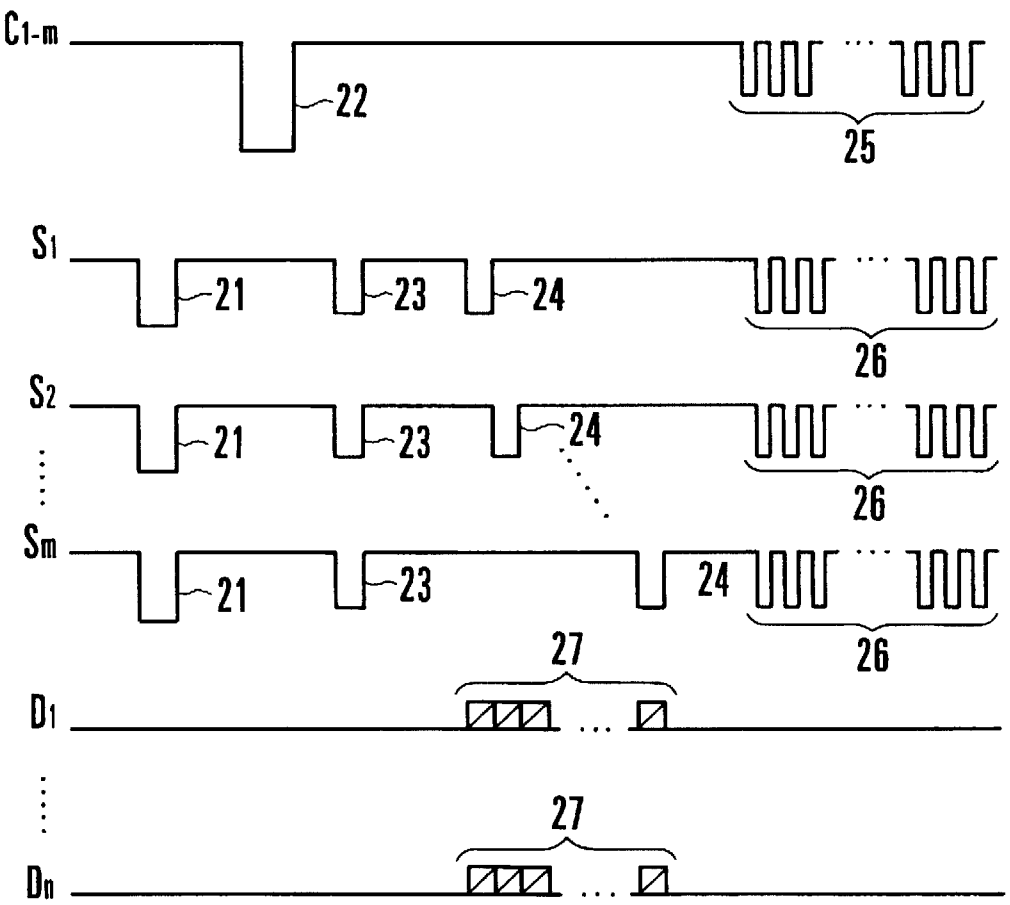
FIGS. 3A to 3F are timing charts, respectively, showing the waveforms of driving voltages to be applied to the respective electrodes of the PDP shown in FIG. 1.

A method of driving the PDP having the above-described arrangement will be explained below with reference to timing charts of FIGS. 3A to 3F. First, as shown in FIGS. 3B to 3D, an erase pulse 21 is applied to row electrodes S1, S2, . . . , Sm of the scan electrodes 3 to initialize the PDP. As a result, light emission of pixels is stopped to set all pixels in an erase state.

As shown in FIG. 3A, a priming discharge pulse 22 is applied to the common electrodes 4. Upon reception of the priming discharge pulse 22, all the pixels are forcibly caused to emit light by discharge, thereby generating wall charges at the insulating layer 6*a*. As shown in FIGS. 3B to 3D, a priming discharge erase pulse 23 is applied to the row electrodes S1, S2, . . . , Sm of the scan electrodes 3 to stop light emission of all the pixels by the priming discharge in order to erase unnecessary charges. By this priming discharge, a subsequent writing discharge can easily occur.

As a result, the wall charges are set in a state suitable for pixel selection. Upon the priming discharge, a scan pulse 24 is time-divisionally applied to the row electrodes S1, S2, . . . , Sm of the scan electrodes 3, as shown in FIGS. 3B to 3D. At the same time, as shown in FIGS. 3E and 3F, a data pulse 27 is applied to column pulses D1 to Dn of the data electrodes 10 in accordance with light emission data in synchronism with the scan pulse 24, thereby causing only a selected pixel (cell) to emit light by discharge. That is, writing discharge occurs at the pixel applied with the data pulse 27 in synchronism with the scan pulse 24. To the contrary, no writing discharge occurs at a pixel not applied with any data pulse 27 in synchronism with the scan pulse 24.

In the pixel where the writing discharge occurs, a positive charge called a wall charge is accumulated at the insulating layer 6*a* on the scan electrode 3. The first sustaining discharge occurs by superposing the positive potential of the wall charge and a first sustain pulse 25 (FIG. 3A) to be applied to the common electrodes 4 on each other. Upon occurrence of the first sustaining discharge, a positive wall charge is accumulated at the insulating layer 6*a* on the common electrode 4, while a negative wall charge is accumulated at the insulating layer 6*a* on the scan electrode 3. As a result, a potential difference in wall charge is generated between the insulating layer 6*a* on the scan electrode 3 and the insulating layer 6*a* on the common electrode 4. A sustain pulse 26 (FIGS. 3B to 3D) to be applied to the scan electrode 3 is superposed on the potential difference in wall charge to allow the second sustaining discharge.

In this manner, the potential difference in wall charge generated by the xth sustaining discharge, and the (x+1)th sustain pulse are superposed on each other to repeatedly allow the sustaining discharge. The repeat frequency of sustaining discharges determines the light emission quantity. At this time, the voltages of the sustain pulses 25 and 26*b* are adjusted in advance to a degree so as not to allow discharge by only these pulse voltages. As a result, a pixel where no writing discharge occurs has no potential of the wall charge before application of the first sustain pulse 25. Therefore, no first and subsequent sustaining discharges occur in this pixel.

Proper voltage values of the sustain pulses 25 and 26 fall within the voltage range wherein both the following two conditions are satisfied. The first condition is that no discharge occurs by only the sustain pulse 25 or 26. The second condition is that the sustaining discharge (surface discharge) through the discharge electrode gap d is kept in a pixel where the wall charge is accumulated upon occurrence of the writing discharge.

To prevent the discharge from occurring by only the sustain pulse 25 or 26, the voltage values of the sustain pulses 25 and 26 must be lower than the Vf of surface discharge with the surface discharge gap d and the Vf of opposing discharge with the opposing discharge gap h. To keep the sustaining discharge (surface discharge), the voltage values of the sustain pulses 25 and 26 must be higher than the minimum surface discharge sustaining voltage.

The range of a proper sustain pulse voltage when the opposing discharge gap h is changed for a constant surface discharge gap d will be described with reference to FIG. 4A. Note that the range of the proper sustain pulse voltage is called a sustaining voltage margin, its lower limit is defined by the minimum surface discharge sustaining voltage, and its upper limit is defined by the Vf of surface discharge and the Vf of opposing discharge.

Figure 4A:
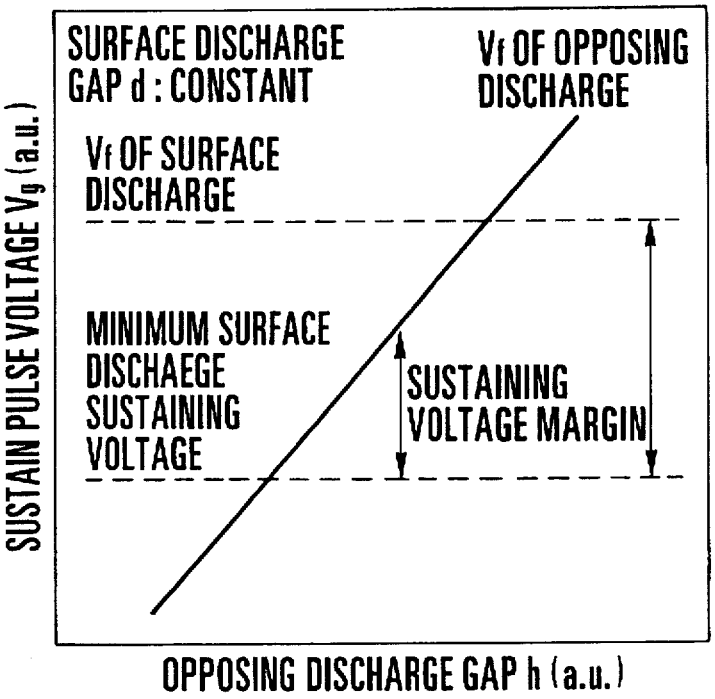
FIG. 4A is a graph showing the relationship between the opposing discharge gap and the sustain pulse voltage to explain the margin of the sustaining voltage pulse shown in FIGS. 3A to 3D.
Figure 4B:
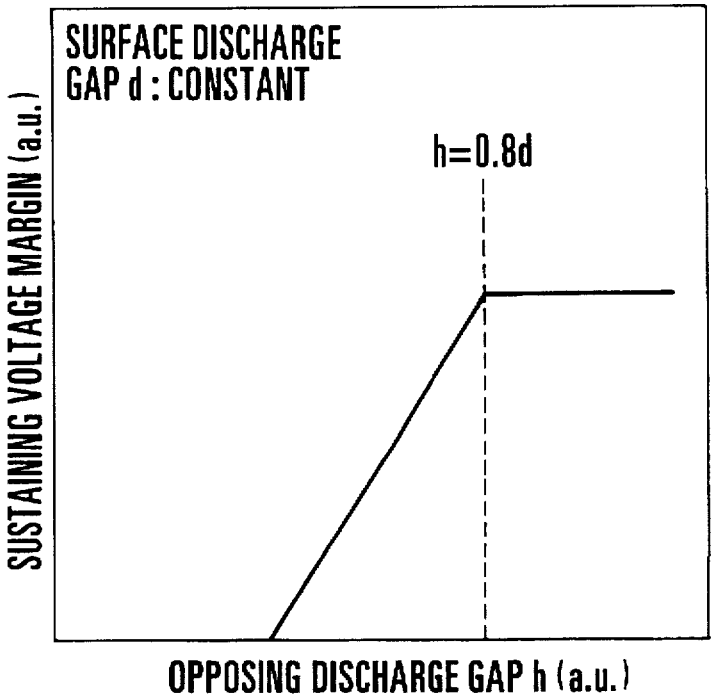
FIG. 4B is a graph showing the relationship between the opposing discharge gap and the sustaining voltage margin.

In FIG. 4A, since the surface discharge gap d is constant, the Vf of surface discharge and the minimum surface discharge sustaining voltage do not change even upon changing the opposing discharge gap h. To the contrary, the Vf of opposing discharge increases with an increase in opposing discharge gap h according to the Paschen's law. A change in sustaining voltage margin upon changing the opposing discharge gap h is shown in FIG. 4B. As is apparent from FIG. 4B, the sustaining voltage margin is maximized and saturated at $h \geqq 0.8$ d, i.e., $h/d \geqq 0.8$.

A proper voltage value of the scan pulse 24 falls within the voltage range wherein both the following two conditions are satisfied. The first condition is that no discharge occurs by only the scan pulse 24. The second condition is that the writing discharge (opposing discharge) through the opposing discharge gap h occurs in a pixel applied with the data pulse 27.

To prevent the discharge from occurring by only the scan pulse 24, the voltage of the scan pulse 24 must be lower than the Vf of surface discharge with the surface discharge gap d and the Vf of opposing discharge with the opposing discharge gap h. To reduce the power consumption, the voltage value of the data pulse 27 must be decreased, and that of the scan pulse 24 must be set as high as possible in accordance with the decreased voltage value of the data pulse 27.

Figure 5A:
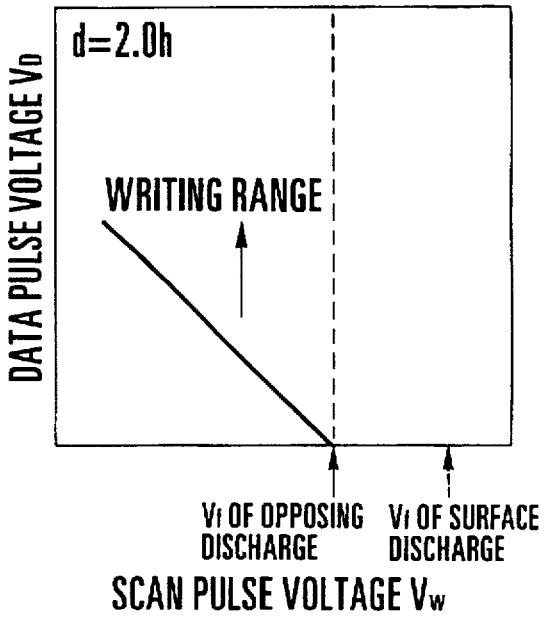
FIGS. 5A and 5B are graphs, respectively, showing the scan pulse voltage and the data pulse voltage.

FIG. 5A shows the minimum value of a voltage value $V_D$ of the data pulse 27 required to allow the writing discharge when a voltage value $V_W$ of the scan pulse 24 is changed. As shown in FIG. 5A, if the scan pulse voltage $V_W$ is increased, the minimum value of the data pulse voltage $V_D$ required to allow the writing discharge gradually decreases.

The potential difference required to allow the opposing discharge is represented by the sum of the scan pulse voltage $V_W$ and the data pulse voltage $V_D$. Since this potential difference is fixed, the scan pulse voltage $V_W$ and the data pulse voltage $V_D$ have the above-described relationship. Therefore, if the scan pulse voltage $V_W$ is increased, the opposing discharge can occur for a low data pulse voltage $V_D$. In FIG. 5A, the range above the minimum value of the data pulse voltage $V_D$ which changes in accordance with the scan pulse voltage $V_W$ is a writing range wherein selective writing discharge can occur.

As shown in FIG. 5A, when the surface discharge gap d is wider than the opposing discharge gap h (d=2.0 h), the voltage (Vf of surface discharge) at which the surface discharge occurs by only the scan pulse 24 is higher than the voltage (Vf of opposing discharge) at which the opposing discharge occurs by only the scan pulse 24. For this reason, when the surface discharge gap d is wide, the writing range can be ensured even for a very low data pulse voltage $V_D$ by increasing the scan pulse voltage $V_W$. The selective writing discharge can occur for each pixel.

Figure 5B:
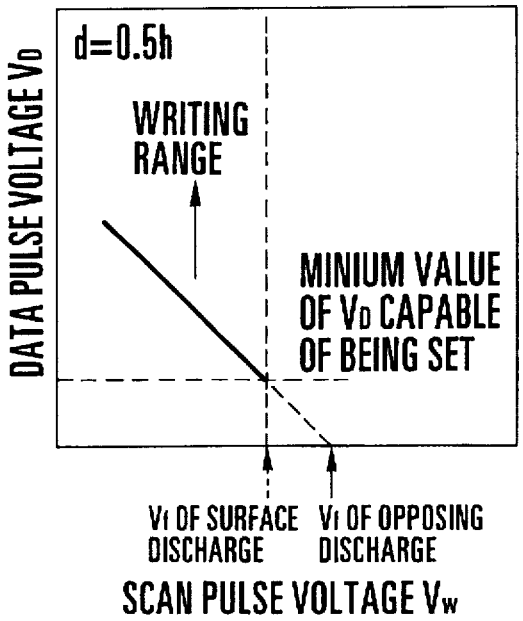

To the contrary, when the surface discharge gap d is narrower than the opposing discharge gap h (d=0.5 h), the voltage (Vf of surface discharge) at which the surface discharge occurs by only the scan pulse 24 is lower than the voltage (Vf of opposing discharge) at which the opposing discharge occurs by only the scan pulse 24, as shown in FIG. 5B. For this reason, when the surface discharge gap d is narrower, the scan pulse voltage $V_W$ cannot be set higher than the voltage (Vf of surface discharge) at which the surface discharge occurs, due to the following reason. If the scan pulse voltage $V_W$ is set higher than the voltage (Vf of surface discharge) at which the surface discharge occurs, the surface discharge undesirably occurs by only the scan pulse 24 in a pixel not applied with any data pulse 27. In this case, a selective writing discharge operation cannot be performed for each pixel. Therefore, in the case of FIG. 5B, the data pulse voltage $V_D$ must be set high because no writing range is present if the data pulse voltage $V_D$ is set lower than the minimum value determined by the Vf of surface discharge.

Figure 5C:
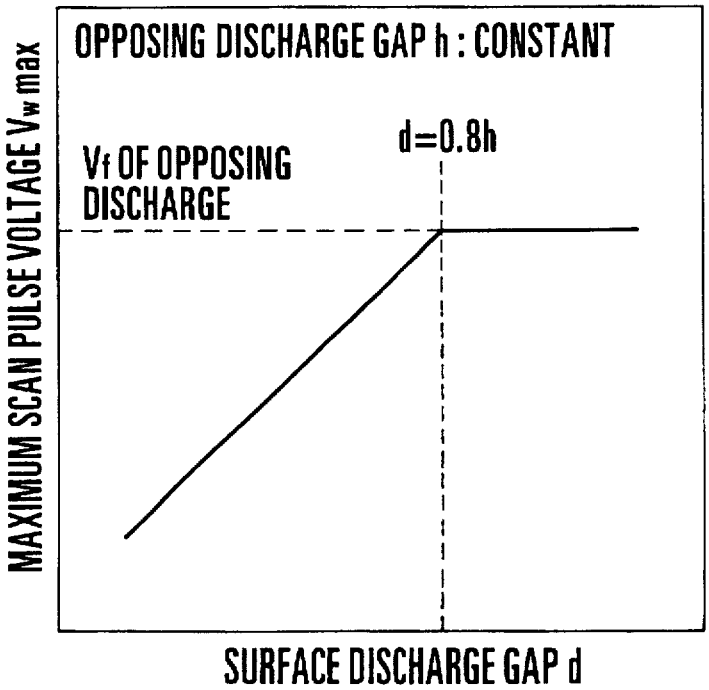
FIG. 5C is a graph showing the relationship between the surface discharge gap and the maximum scan pulse voltage.

In the present invention, when the surface discharge gap d is changed for a constant opposing discharge gap h, a maximum scan pulse voltage $V_W$max is saturated with the voltage (Vf of opposing discharge) at which the opposing discharge occurs by only the scan pulse 24 within the range of $d \geqq 0.8$ h, i.e., $h/d \leqq 1.25$, as shown in FIG. 5C. FIG. 5C shows the maximum scan pulse voltage $V_W$max as the upper limit of the scan pulse voltage $V_W$ capable of being set when the opposing discharge gap h is changed. At $d<0.8$ h, i.e., $h/d>1.25$, the maximum scan pulse voltage $V_W$max is equal to the voltage value at which the surface discharge occurs, so a low data pulse voltage $V_D$ cannot be used.

As described above, according to the present invention, when the surface discharge gap d is increased, the opposing discharge gap h is also changed in correspondence with the increased surface discharge gap d to set the value h/d within the range of 0.80 to 1.25.

With this setting, the PDP attains the following effects which have not conventionally been obtained. That is, since $h/d \geqq 0.8$, the sustaining voltage margin is large, as shown in FIG. 4B, so that the PDP can be driven sufficiently. Since $h/d \leqq 1.25$, the scan pulse voltage value $V_W$ can be increased to the Vf of opposing discharge, as shown in FIG. 5C. In this case, pixels can be selectively caused to emit light at a low data pulse voltage $V_D$, reducing the power consumption. If the above-mentioned h/d is set in combination with an increase in surface discharge gap effective for increasing the luminous efficiency, the PDP can be efficiently driven with a small power consumption under sufficient driving conditions.

The above embodiment exemplifies the case using, as the driving waveform of the PDP, a driving waveform of the scan/sustain separation scheme in FIGS. 3A to 3F which is separated into the scan period when the writing discharge selectively occurs for each pixel, and the sustain period when the sustaining discharge is kept. However, the driving waveform is not limited to this. The present invention can also be applied to a case using, e.g., a driving waveform of the scan/sustain mixing scheme wherein a scan pulse is generated between sustain pulses.

Figure 6:
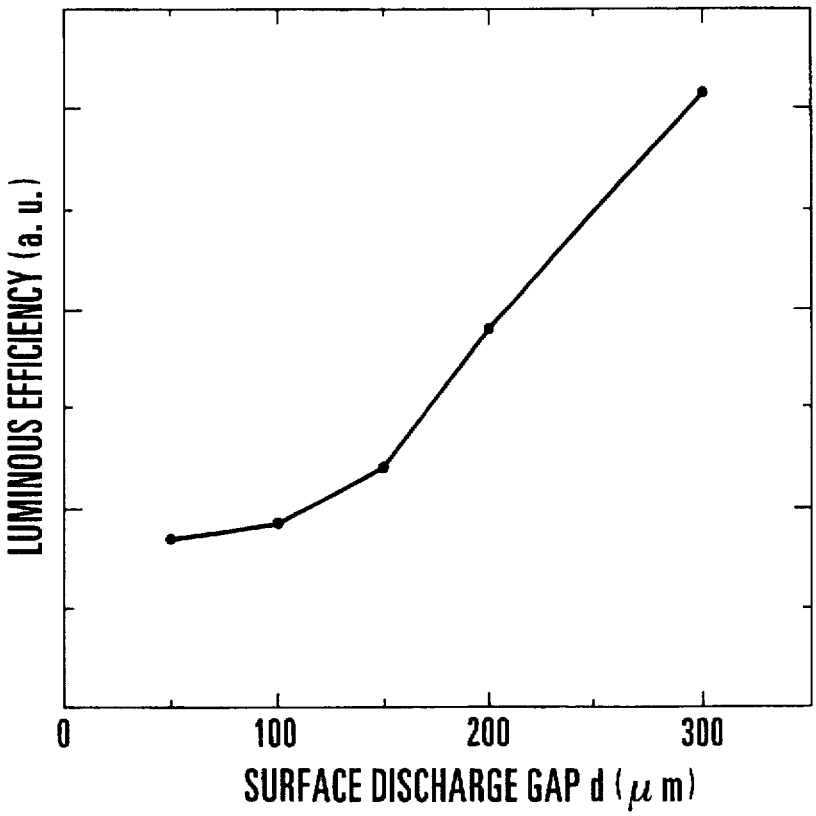
FIG. 6 is a graph showing the dependency of the luminous efficiency on the surface discharge gap.
Figure 7:
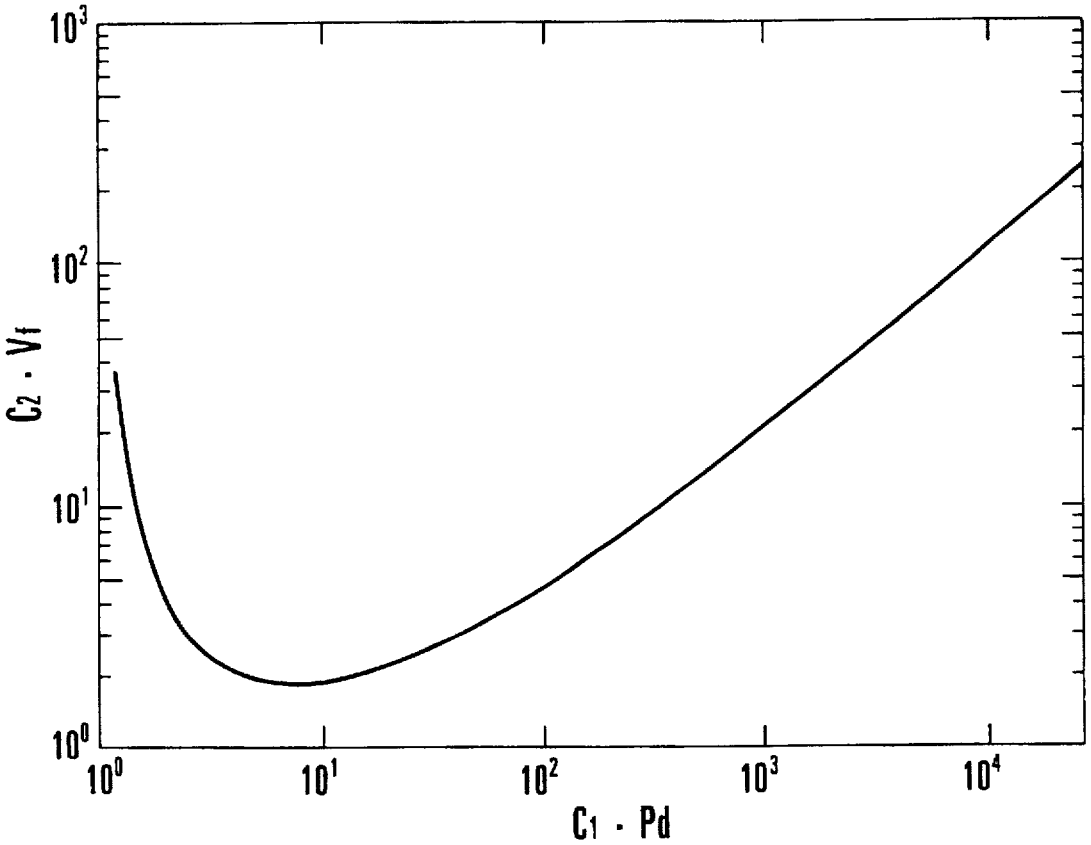
FIG. 7 is a graph for explaining the Paschen's law.

FIG. 6 shows the dependency of the luminous efficiency on the surface discharge gap. As shown in FIG. 6, the luminous efficiency defined by the light emission quantity per unit power consumption increases with an increase in surface discharge gap d. Particularly, the luminous efficiency greatly increases at 150 μm or more. Therefore, if the surface discharge gap d is set to 150 μm, and the opposing discharge gap h is set within the range of 120 μm to 187.5 μm, the luminous efficiency higher than that of the conventional surface discharge AC-PDP can be attained.

The opposing discharge gap h is set to almost the conventional value of 150 μm. The surface discharge gap d is set at, particularly, 150 μm or more within the allowable range of 120 μm to 187.5 μm in order to realize a high luminous efficiency. With this setting, the luminous efficiency higher than that of the conventional surface discharge AC-PDP can also be attained.

The 150-μm surface discharge gap described above is determined on the basis of limitations on the breakdown voltage of a current driving circuit IC. If a higher-breakdown-voltage IC can be realized to drive the PDP having a surface discharge gap wider than 150 μm in future, a higher efficiency can be obtained, as a matter of course.

As has been described above, according to the present invention, the ratio of the gap size between the two plates to the gap size between the scan and common electrodes is set to fall within the range of 0.80 to 1.25. As a result, the following three effects can be obtained.

First, the sustaining margin can be set larger. That is, since no opposing discharge occurs upon application of the sustain pulse, the sustain pulse voltage can be increased to the Vf of surface discharge.

Second, the data voltage can be decreased to reduce the power consumption. That is, since no surface discharge occurs upon application of the scan pulse, the scan pulse voltage $V_W$ can be increased to a value immediately before the opposing discharge occurs by only the scan pulse.

Third, a wide-gap panel considered to attain a high luminous efficiency can be easily used because a decrease in sustaining margin generated in the wide-gap panel is reduced.

What is claimed is:

1. An AC plasma display panel comprising:

first and second plates arranged opposite to each other through a predetermined gap, at least one of which is transparent;

a discharge space defined by said first and second plates and filled with a discharge gas, the discharge space being partitioned into a plurality of pixels;

a plurality of pairs of scan electrodes and common electrodes formed on an inner surface of said first plate in a row direction to allow emission sustaining surface discharge therebetween; and a plurality of data electrodes formed on an inner surface of said second plate in a column direction to allow writing emission opposing discharge between said data electrodes and said scan electrodes, said pixels being arranged at intersections of said scan and common electrodes and said data electrodes, wherein the following relation is established $0.80 \leqq h/d \leqq 1.25$ where d is a surface discharge gap between said scan and common electrodes, and h is an opposing discharge gap between said scan and common electrodes and said data electrodes.

2. A panel according to claim 1, wherein the surface discharge gap $d \geqq 150$ μm.

3. A panel according to claim 1, further comprising:

a first insulating layer formed on said inner surface of said first plate having said scan and common electrodes; and a second insulating layer formed on said inner surface of said second plate having said data electrodes, so that the opposing discharge gap h is a gap between said first and second insulating layers.

4. A panel according to claim 3, further comprising:

a protective layer formed on said first insulating layer;

a visible light emission phosphor formed on said second insulating layer; and a plurality of partitions for partitioning the discharge space defined by said first and second insulating layers in correspondence with said pixels, so that the discharge gas filled in the discharge gas generates an ultraviolet ray for exciting said phosphor.

* * * * *